US006412899B1

(12) United States Patent
Choo

(10) Patent No.: US 6,412,899 B1
(45) Date of Patent: Jul. 2, 2002

(54) METHOD AND A DEVICE FOR DETECTING AN INK CARTRIDGE

(75) Inventor: Jong-Yung Choo, Seoul (KR)

(73) Assignee: Samsung Electronics, Co., Ltd., Suwon (KR)

( * ) Notice: Subject to any disclaimer, the term of this patent is extended or adjusted under 35 U.S.C. 154(b) by 0 days.

(21) Appl. No.: 09/176,304

(22) Filed: Oct. 22, 1998

(30) Foreign Application Priority Data

Oct. 21, 1997 (KR) ..... 97-53946

(51) Int. Cl.[7] ..... B41J 29/393
(52) U.S. Cl. ..... 347/19
(58) Field of Search ..... 347/19, 23

(56) References Cited

U.S. PATENT DOCUMENTS 5,168,291 A * 12/1992 Hiramatsu et al. ..... 347/19
5,245,362 A * 9/1993 Iwata et al. ..... 346/140 R
5,508,722 A * 4/1996 Saito et al. ..... 347/19
5,831,647 A * 11/1998 Kawakami et al. ..... 347/36
5,842,800 A * 12/1998 Bailey et al. ..... 400/703
5,953,024 A * 9/1999 Lee et al. ..... 347/23
6,137,503 A * 10/2000 Hashimoto et al. ..... 347/23

FOREIGN PATENT DOCUMENTS

JP 08310047 A * 11/1996

* cited by examiner

*Primary Examiner*—John Barlow
*Assistant Examiner*—Julian D. Huffman
(74) *Attorney, Agent, or Firm*—Robert E. Bushnell, Esq.

(57) ABSTRACT

A device and a method for detecting the presence of an ink cartridge in an ink jet printer starts with powering on a printer. Second, the carriage is moved until it reaches the home position. After the carriage has been initialized, the carriage continues to move for a predetermined distance. If a sensor detects the presence of an ink cartridge then a second detect signal is sent to the controller. Otherwise, an error signal is sent from the controller to alert a user that the ink jet printer requires the insertion of an ink cartridge.

12 Claims, 5 Drawing Sheets

METHOD AND A DEVICE FOR DETECTING AN INK CARTRIDGE

CLAIM OF PRIORITY

This application makes reference to, incorporates the same herein, and claims all rights accruing under 35 U.S.C. §119 through my patent application entitled Device and Method for Detecting Presence of Ink Cartridge earlier filed in the Korean Industrial Property Office on the 21st day of October 1997 and there duly assigned Serial No. 1997/53946.

BACKGROUND OF THE INVENTION

1. Field of the Invention

The present invention relates to an ink jet printer and, more specifically, to a device and a method for detecting the presence of an ink cartridge in an ink jet printer.

2. Background Art

An ink jet printer performs the printing operation by moving a carriage, containing an ink cartridge, back and forth during the printing process. To ensure accurate printing the carriage is often brought to a standard position to begin the printing process. To increase the quality of printing it is important that the carriage firmly hold the ink cartridge, thus allowing the print head of the ink cartridge to be accurately positioned. Upon powering the printer, a controller causes the printer to carry out an initialization procedure that starts with positioning the carriage at a predetermined position, also referred to as the home position.

Sometimes, however, the printing operation may be attempted without an ink cartridge being installed in the carriage. This can happen when a used ink cartridge is being replaced with a new ink cartridge, but the user inadvertently forgets to install the new cartridge prior to powering the printer. Contemporary methods of determining the presence of an ink cartridge can result in the consumption of power or the contamination of the interior of the printer.

I believe that it may be possible to improve on the contemporary art by providing a method and a device for detecting the presence of an ink cartridge that does not require an additional sensor beyond that needed to initialize the carriage, that is economical to manufacture and does not reduce the efficiency of assembly of ink jet printers, that does not increase the power consumption of the printer, that does not result in the contamination of the interior of the housing, and that is easy to repair and maintain.

SUMMARY OF THE INVENTION

Accordingly, it is an object of the present invention to provide an improved device and an improved method for detecting the presence of an ink cartridge in an ink jet printer.

It is another object to provide a device and a method for detecting the presence of an ink cartridge in an ink jet printer that does not require an additional sensor, beyond that needed for the proper initialization of the printer.

It is still another object to provide a device and a method for detecting the presence of an ink cartridge in an ink jet printer that does not increase the power consumption of the printer.

It is still another object to provide a device and a method for detecting the presence of an ink cartridge in an ink jet printer that does not result in the contamination of the interior of the housing.

It is yet another object to provide a device and a method for detecting the presence of an ink cartridge in an ink jet printer that is easy to repair and maintain.

It is still yet another object to provide a device and a method for detecting the presence of an ink cartridge in an ink jet printer that is economical to manufacture and does not reduce the efficiency with which the devices can be assembled.

To achieve these and other objects, a device and a method are provided for detecting the presence of an ink cartridge in an ink jet printer. The device can be operated with a regular ink jet printer. Inside the ink jet printer is a reciprocating carriage that transports an ink cartridge across a cut sheet of printable medium to form images on the cut sheet. The carriage may have a first blade on it that is aligned to pass a light emitter and a light detector that are mounted along the path of travel of the carriage. The combination of the first blade and the light emitter and light detector can be used to initialize the printer after the printer has been turned on. Once the printer is powered the computer moves the carriage until the first blade comes between the light emitter and light detector. Then, the controller can determine that the carriage is in the starting position, also referred to as the home position. To allow the controller to determine whether there is actually an ink cartridge in the carriage a second blade may be placed on the ink cartridge. When the ink cartridge is properly mounted in the carriage the first blade and the second blade are both positioned in a common geometric plane. Thus, after the controller has confirmed the position of the carriage, the carriage continues to move a predetermined distance in the direction it was moved to initialize the printer. If a cartridge having a second blade passes through the light emitter and light detector then a detect-signal is sent to the controller. If the controller receives a first detect-signal, representing the position of the carriage, and does not receive a second detect-signal, representing the second blade of the ink cartridge, after moving the carriage a predetermined distance, then an error-signal is sent out by the controller to alert a user to the absence of an ink cartridge in the ink jet printer.

A method for detecting the presence of an ink cartridge in an ink jet printer starts with powering on a printer. Second, the carriage is moved until it reaches the home position. After the carriage has been initialized, the carriage continues to move for a predetermined distance. If the pair of optical scanners detects the second blade of the ink cartridge then a second detect signal is sent to the controller. Otherwise, an error signal is sent from the controller to alert a user that the ink jet printer requires the insertion of an ink cartridge.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
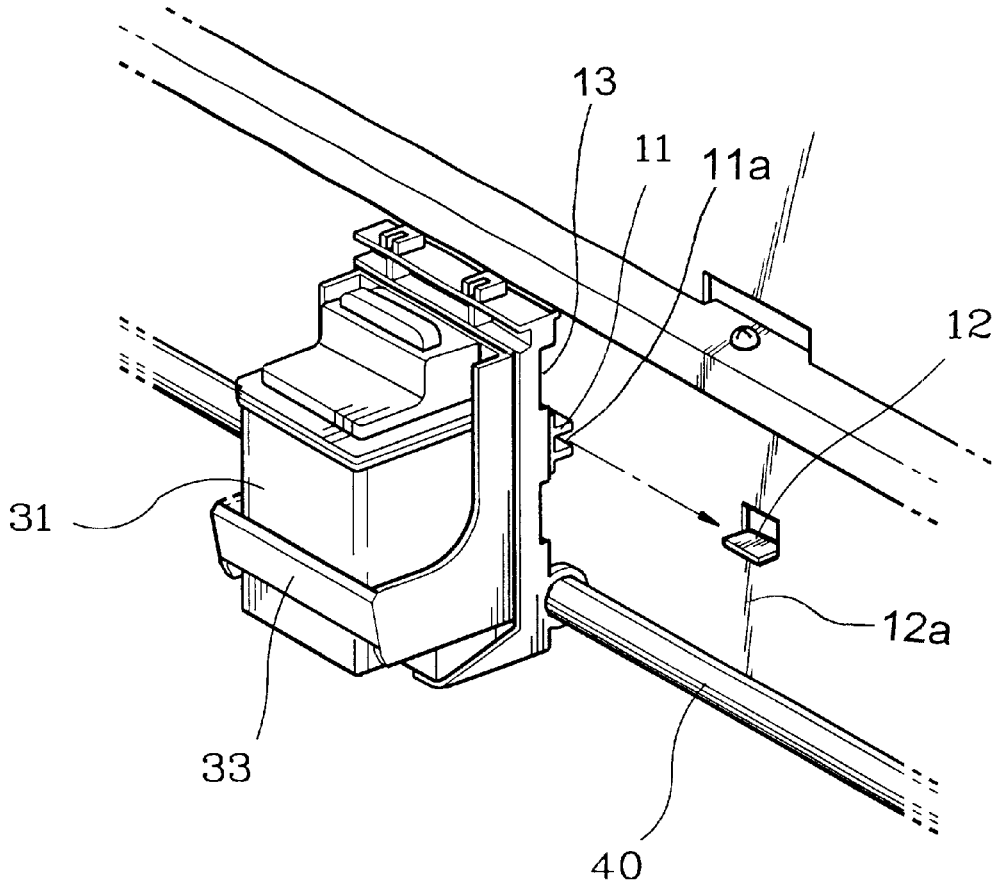
FIG. 1 is a perspective views illustrating a carriage moving towards the home position to carry out the initialization process.

Turning now to the drawings, FIG. 1 illustrates carriage 33 moving towards initialization position, or home position, 12*a*. In this illustration the home position is positioned near an extreme end of shaft 40. The carriage is moved in a reciprocal manner along a path as defined by shaft 40. A motor (not shown) causes carriage 33, that is carrying ink cartridge 31, to move under the control of a controller (not shown). The home position is determined by frame tab 12 that protrudes from an inner surface of the housing. Home position sensor 11 is fixed to rear surface 13 of carriage 33 to receive frame tab 12 through slot 11*a* when the carriage travels to the right and reaches the home position. That is, home position sensor 11 will straddle frame tab 12 causing a signal to be generated. This allows the controller to establish the position of carriage 33.

This allows the controller to determine whether carriage 33 is in the home position by checking the output of home position sensor 11. Equally important, when ink cartridge 31 is firmly seated within carriage 33, the exact position of the ink cartridge and its print head can also be calculated.

Figure 2:
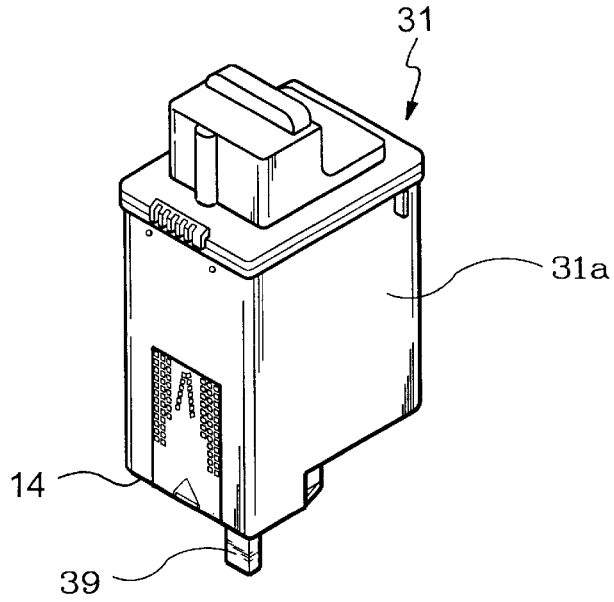
FIG. 2 is a perspective view of an ink cartridge as constructed according to the principles of the present invention.
Figure 3:
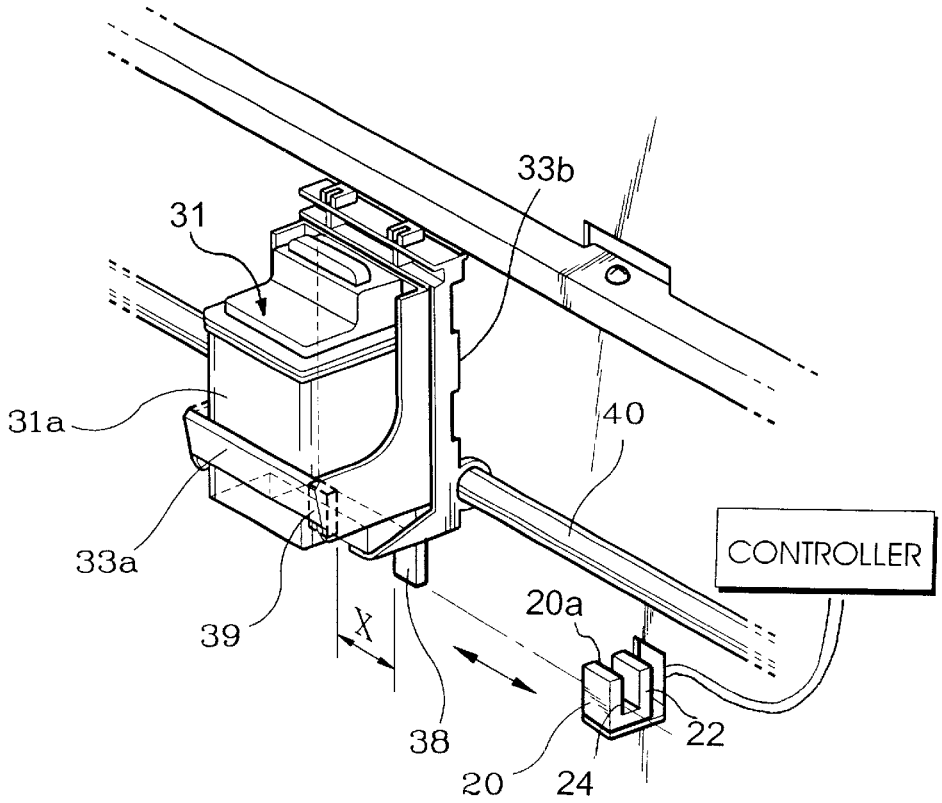
FIG. 3 is a perspective view of an ink jet printer as constructed according to the principles of the present invention.

As shown in FIGS. 2 and 3, cartridge tab, or second blade, 39 is attached to lower surface 14 of ink cartridge 31*a* such that, when installed, the second blade will protrude from the underside of carriage 33*a*. Carriage 33*a* has a first blade 38 that projects downward from the bottom of the carriage. First blade 38 and second blade 39 occupy the same geometric plane. As carriage 33*a* travels along shaft 40 blades 38 and 39 maintain a fixed distance, denoted "X", between the respective opposing faces between the first and second blades.

Rather than using a light emitter and a light detector for each of the above blades, the preferred embodiment of the present invention uses light emitter and light detector 20 that are fixed on an inner wall of the ink jet printer. The actual positioning of the blades and the light emitter and light detector can be different from that shown in FIG. 3. For example, the blades can be mounted on rear side 33*b* and the rear side of ink cartridge 31 and the light emitter and light detector can project out of the inner wall of the ink jet printer. The mounting location of light emitter and light detector 20 is such that, as carriage 33*a* moves along shaft 40, both first blade 38 of carriage 33 and second blade 39 of ink cartridge 31 pass through slot 20*a* between opposing optical sensors 22 and 24.

Figure 4A:
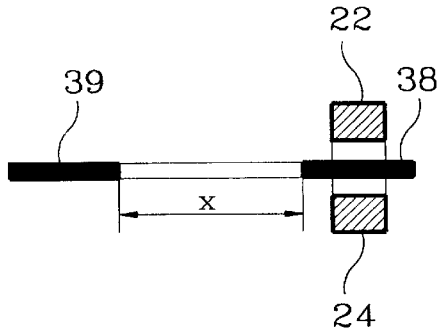
FIGS. 4A–4D are diagrams illustrating the positional relationship of the first blade of the carriage and the second blade of the ink cartridge with respect to the light emitter and light detector of the inkjet printer of FIG. 3.
Figure 4B:
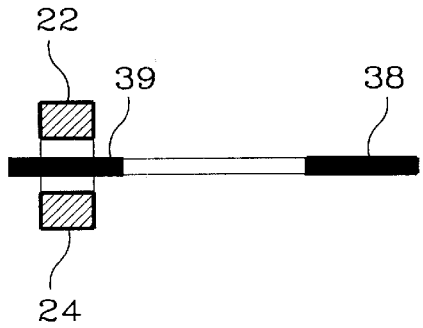
Figure 4C:
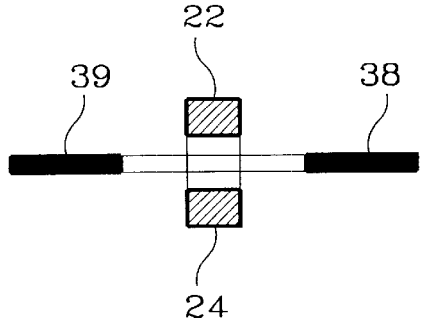
Figure 4D:
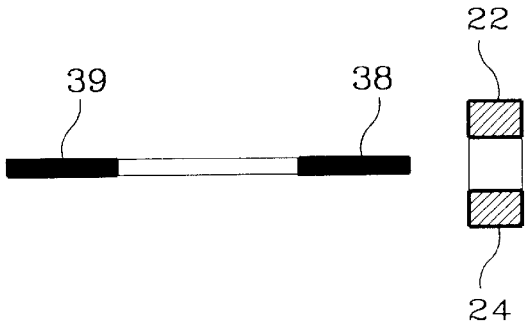

During initialization of a carriage in an ink jet printer as constructed according to the present invention, the relative position of blades 38 and 39 with respect to light emitter and light detector 20 will, upon activating the power supply of the printer, be in one of four basic alignments, as shown in FIGS. 4A–4D. FIGS. 4A and 4B show the states where one of the blades is detected by light emitter and light detector 20. In FIG. 4A first blade 38 of carriage 33 is detected and in FIG. 4B second blade 39 of ink cartridge 31 is detected. In both FIG. 4C and FIG. 4D neither blade is detected by the light emitter and light detector. As shown in FIG. 4C, the blades can straddle the light emitter and light detector. FIG. 4D illustrates the both blades 38 and 39 being completely separated (distanced) from the light emitter and light detector.

Figure 5:
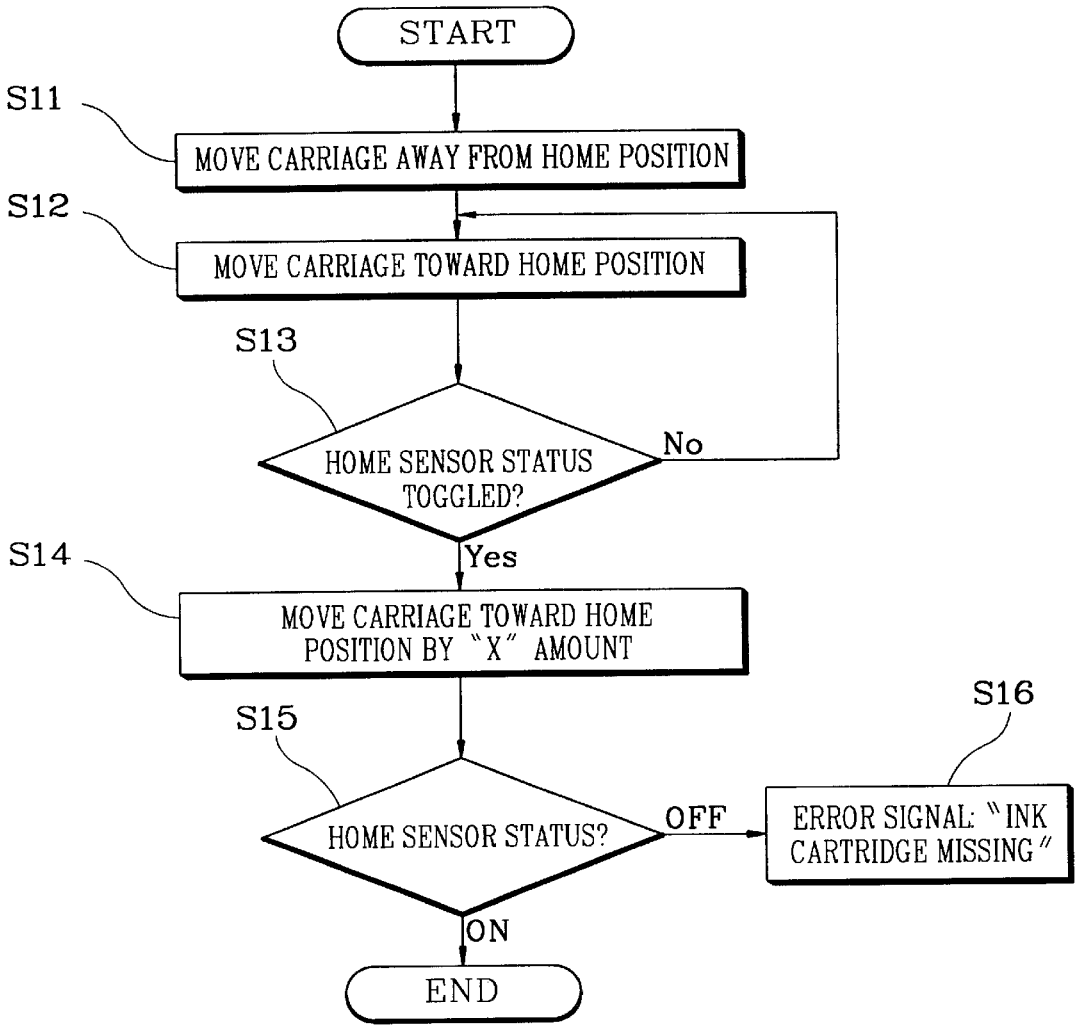
FIG. 5 is a flowchart illustrating a method for detecting the presence of an ink-jet cartridge in an ink jet printer according to the principles of the present invention.
Figure 6A:
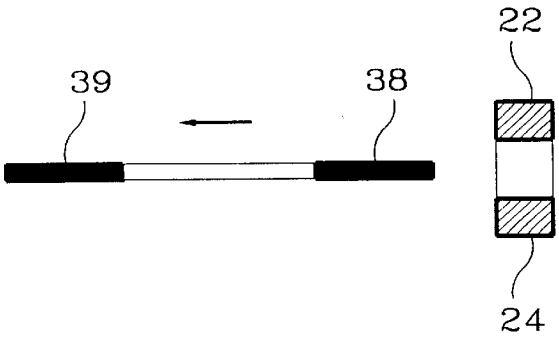
FIGS. 6A–6C are diagrams illustrating the operation of the carriage, according to the flowchart of FIG. 5.

A flowchart illustrating a process for detecting the presence of an ink cartridge is shown in FIG. 5. The process starts when the power to the ink jet printer is activated. First, during step S11, the carriage is moved away from the home position to ensure that carriage 33*a* will approach light emitter and light detector 20 from an orientation shown in FIG. 6A.

Figure 6B:
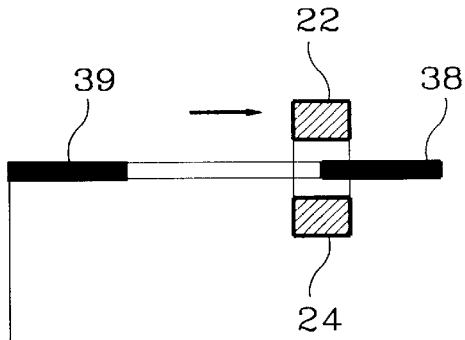

Then, in step S12, carriage 33*a* is moved toward the home position until the light emitter and light detector output a detect-signal to the controller. The detect-signal is sent while the first blade of the carriage is interposed between the light emitter and light detector, as shown in FIG. 6B. When the light signal traveling between optical sensors 22 and 24 is first interrupted by the presence of the first blade 39, the light emitter and light detector are activated or turned on, and as carriage 33*a* continues along its path, the light signal is reestablished and the sensor is deactivated or turned off.

Figure 6C:
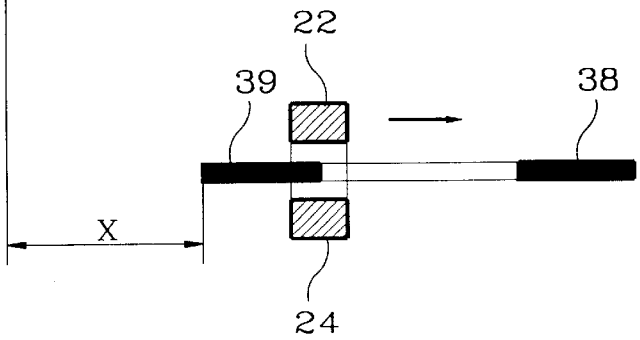

In step S13, the status of the light emitter and light detector is checked. After the light emitter and light detector detects first blade 38, in step S14, the carriage is moved a predetermined distance "X", as shown in FIG. 6C. in the preferred embodiment, however, this distance can be increased by the width of half of one of the blades to increase operation al reliability.

Then, in step S15, if light emitter and light detector 20 detect second blade 39 of the ink cartridge, the presence of an ink cartridge is confirmed and the initialization process and the ink cartridge process are complete. After the presence of the ink cartridge is confirmed, the printer is ready to print. If, light emitter and light detector 20 do not generate a second detect signal before a predetermined distance has been traveled by the carriage, then the controller sends an error-signal to alert a user that an ink cartridge needs to be inserted in to the electrophotographic apparatus, during step S16.

Accordingly, as explained above, the present invention can verify whether an ink cartridge is installed in the carriage of a printer before initiating a printing operation by using a single sensor and without the initialization procedure causing the jetting of ink. Although this preferred embodiment of the present invention has been disclosed for illustrative purposes, those skilled in the art will appreciate that various modifications, additions and substitutions are possible, without departing from the scope and spirit of the invention as disclosed in the accompanying claims. For example, it should be understood that the type of sensor that is used and the portion of the carriage or the ink cartridge that is detected is not critical to the invention. What is important is that by moving the carriage a predetermined distance the presence of an ink cartridge can be detected. It is also possible that other benefits or uses of the currently disclosed invention will become apparent over time.

What is claimed is:

1. An ink jet printer having a detector device for detecting an ink cartridge, said ink jet printer comprising:

a carriage slidably mounted along a carriage path in said ink jet printer, said carriage having a first blade projecting towards a base of said ink jet printer;

said ink cartridge mountable in said carriage, said ink cartridge having a second blade projecting towards said base, said second blade coplanar with said first blade and spaced therefrom by a predetermined distance;

a sensor mounted along said carriage path, said sensor sending a detection-signal to a controller when a one of said carriage and said ink cartridge is detected;

said controller receiving said detection-signal and adapted to generate an error-signal when one and only one said detection-signal is received after said carriage has moved a predetermined distance.

2. The ink jet printer of claim 1, wherein said sensor comprises a light emitter and a light detector positioned along said carriage path to detect said first blade and said second blade when said first blade and said second blade pass between said light emitter and light detector.

3. The ink jet printer of claim 2, wherein said predetermined distance is a distance between the center of said first blade and the center of said second blade.

4. An ink jet printer having a detector device for detecting an ink cartridge, said ink jet printer comprising:

a carriage slidably mounted along a carriage path in said ink jet printer, said carriage having a first blade projecting towards a base of said ink jet printer;

said ink cartridge mountable in said carriage, said ink cartridge having a second blade projecting towards said base;

a sensor mounted along said carriage path, said sensor sending a detection-signal to a controller when a one of said carriage and said ink cartridge is detected;

said controller receiving said detection-signal and adapted to generate an error-signal when one and only one said detection-signal is received after said carriage has moved a predetermined distance.

5. The ink jet printer of claim 4, wherein said second blade is coplanar with said first blade and spaced therefrom by a predetermined distance.

6. The ink jet printer of claim 5, wherein said sensor comprises a light emitter and a light detector positioned along said carriage path to detect said first blade and said second blade when said first blade and said second blade pass between said light emitter and light detector.

7. The ink jet printer of claim 6, wherein said predetermined distance is a distance between the center of said first blade and the center of said second blade.

8. A process for detecting an ink cartridge in an ink jet printer, said cartridge having a first blade projecting therefrom, said method comprising the steps of:

(1) moving a carriage along a path of travel in said inkjet printer, said carriage having a second blade projecting therefrom, said second blade coplanar with said first blade and spaced therefrom by a predetermined distance;

(2) detecting when said second blade of said carriage passes a sensor;

(3) after said second blade of said carriage is detected by said sensor, continuing to move said carriage for at least a predetermined distance;

(4) sending an error-signal to a controller if said first blade of said ink cartridge is not detected by said sensor after said carriage is moved said predetermined distance, thereby sending said error-signal if one and only one of said carriage and said ink cartridge is detected.

9. The process of claim 8, wherein said predetermined distance is a width of said carriage.

10. A detector subassembly adapted for detecting an ink cartridge in an inkjet printer, said ink jet printer comprising:

a carriage slidably mounted along a carriage path in said ink jet printer, said carriage having a first blade projecting towards a base of said ink jet printer;

said ink carriage mountable in said carriage, said ink cartridge having a second blade projecting towards said base, said second blade coplanar with said first blade and spaced therefrom by a predetermined distance;

said detector subassembly comprising:

a sensor mounted along said carriage path, said sensor sending a detectionsignal to a controller when a one of said carriage and said ink cartridge is detected; and said controller receiving said detection-signal and adapted to generate an errorsignal when one and only one said detection-signal is received after said carriage has moved a predetermined distance.

11. The detector subassembly of claim 10, wherein said sensor comprises a light emitter and a light detector positioned along said carriage path to detect said first blade and said second blade when said first blade and said second blade pass between said light emitter and light detector.

12. The detector subassembly of claim 11, wherein said predetermined distance is a distance between the center of said first blade and the center of said second blade.

* * * * *